United States Patent [19]

Lomnicki et al.

[11] 4,340,099

[45] Jul. 20, 1982

[54] CHIPPER MACHINE

[75] Inventors: Joseph J. Lomnicki, Portland; Donald A. Miller, Tigard, both of Oreg.

[73] Assignee: Mainland Industries, Inc., Lake Oswego, Oreg.

[21] Appl. No.: 175,527

[22] Filed: Aug. 5, 1980

[51] Int. Cl.[3] ..... B27C 9/00

[52] U.S. Cl. ..... 144/220

[58] Field of Search ..... 144/39, 218, 220, 223, 144/235

[56] References Cited

U.S. PATENT DOCUMENTS 4,266,584 5/1981 Lomicki ..... 144/220

*Primary Examiner*—W. D. Bray

*Attorney, Agent, or Firm*—Chernoff & Vilhauer

[57] ABSTRACT

A chipper machine for simultaneously preparing a flat surface on a workpiece and comminuting material removed from the workpiece to produce the flat surface, in which several individually removable chipper knives are mounted on a hub mounted detachably on a rotatable arbor. A workpiece-supporting anvil includes a drop front section to permit removal of the chipper head from the arbor. The hub and arbor are steeply tapered to allow the chipper head to be easily removable from the arbor, and the chipper machine is provided with sharpened chipper knives by replacement of the entire chipper head. The several chipper knives are removed, sharpened, replaced, adjusted and again ground to cut uniformly with the chipper head removed from the chipper machine.

5 Claims, 8 Drawing Figures

FIG. 4
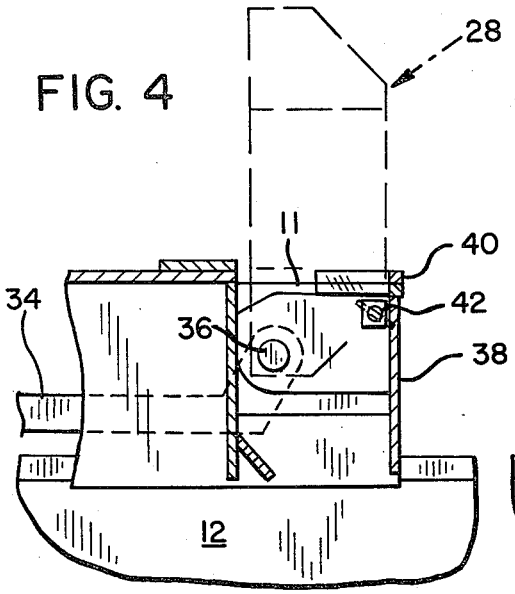
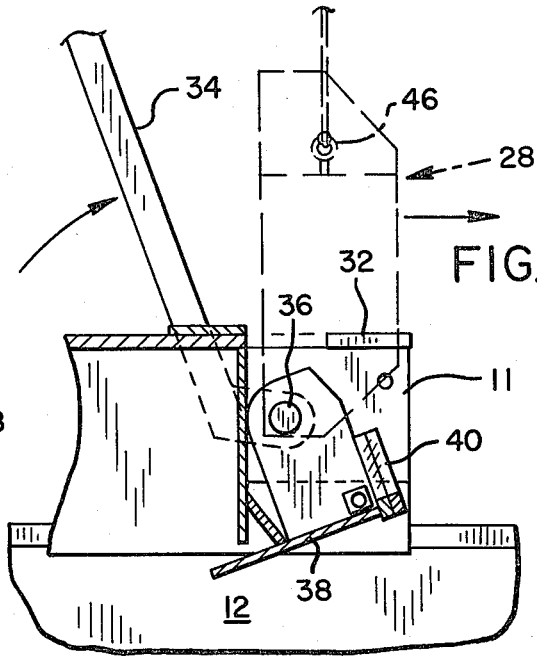
FIG. 5

CHIPPER MACHINE

BACKGROUND AND SUMMARY OF THE INVENTION

The present invention relates to chipper machines usable for removing portions of a workpiece such as a log, leaving behind a smooth flat surface, and in particular to apparatus and a method permitting such chipper machines to be operated more efficiently.

Chipper machines are large machines for removing and simultaneously comminuting parts of a workpiece, for example removing the rounded outer portions of a log to prepare a flat surface on one or more sides of the log as a reference for further cutting of the log into cants and boards. Typically a chipper machine comprises a horizontal mandrel supported in suitable radial and thrust bearings, with a chipper head hub fixedly attached to the mandrel. Arranged about the chipper head hub are several knives which extend generally radially and which comprise two legs joined by a curved portion.

Generally, a short leg of each chipper knife extends perpendicular to the axis of the mandrel, with its edge thus rotating in a plane as the chipper head is rotated with the mandrel. A long leg extends outwardly at an oblique angle from the short leg and away from the workpiece, so that the long leg edge describes a frustoconical surface as the chipper head is rotated.

As the chipper head is rotated the workpiece is fed past the chipper head in a direction perpendicular to the axis of rotation, so that the short legs of the blades cut a smooth flat surface on the workpiece, while the obliquely angled long legs of each chipper knife cut portions of the workpiece into small chips for convenient handling and further use. Such chipper machines are customarily used in conjunction with headrigs in saw mills, to slab logs and prepare cants for further sawing, and as edgers to cut waste wood from the edges of sawn boards in preparing dimension lumber.

In the past a chipper head hub has been fastened practically permanently to its mandrel, with knife holders fastened to the hub. Individual chipper knives are clamped adjustably in the knife holders and are individually removable for sharpening. An example of such individually removable knives and clamping holders is disclosed in Miller U.S. Pat. No. 3,777,793, the disclosure of which is hereby incorporated herein by reference.

When the knife edges of such a chipper machine begin to dull, it has previously been the practice to shut down the chipper machine and individually replace each chipper knife in its respective knife holder, adjusting the position of each chipper knife on the chipper head while the chipper head remains installed in the chipper machine. In fact, in most, if not all previous chipper machines, it is impossible to remove the chipper head from its arbor without first removing the mandrel from its bearings in the frame of the chipping machine, because of chip deflecting shrouding and work supporting anvils, which limit axial motion of the chipper head in the direction required to remove it from its arbor.

This procedure of individually replacing and adjusting resharpened chipper knives ordinarily requires about 20 to 30 minutes, and must be carried out in a dirty, usually noisy, environment which is not conducive to accuracy. This method of replacing dulled chipper knives is therefore subject to two serious deficiencies, both of which lead to unnecessary waste. First, the 20 to 30 minute period required for replacement of individual knives on the chipper head causes a significant reduction in the output of the chipper machine. Second, adjustment of the individual knives, even when done with the greatest care, under such circumstances is not as accurate as is desired. Any inaccuracy or variation in the location of the various knives of a single chipper head may result in wasteful unevenness on the plane surface of the log being slabbed or the lumber being edged by the chipper. This unevenness may require later planing of the wood product, an otherwise unnecessary step wasting time and wood. The inevitable dust and dirt present around a chipper machine which has been in operation often contributes to inaccuracy in positioning the replaced chipper knives, and additionally results in increased risk of damage to the newly resharpened chipper knife edges and injury to personnel replacing and adjusting chipper knives.

What is desired, then, is a chipper machine capable of being provided with resharpened knives in a significantly shorter amount of time, with a greater amount of accuracy than has previously been possible by replacing individual chipper knives on the chipper head. The chipper machine and the method of setting up the chipper knives of the chipper head according to the present invention greatly reduce the amount of time during which a chipper machine is out of operation because of dulled chipper knives, and simultaneously result in a more accurately cut plane surface on the workpiece.

The present invention provides a chipper machine having a chipper head which is quickly and easily removable from the arbor on which it is mounted for rotation. In the chipper machine of the present invention the arbor on which the chipper head is mounted is provided with a steep conical taper. For example, a reduction in arbor diameter of $3\frac{1}{2}$ inches per foot of arbor length permits the chipper head to be easily removed from the arbor, once a securing bolt is loosened. An attachment point is provided to permit the chipper head to be suspended, for example from a crane, during removal from the arbor. A portion of the housing of the chipper machine, such as a drop front anvil, which ordinarily may be used to support the workpiece being chipped, is removable from a position obstructing removal of the chipper head, so that the chipper head may be easily removed and replaced.

As a result, it is necessary only to move the anvil drop front, remove the securing bolt holding the chipper head onto the arbor, tap the hub of the chipper head to slide it from the mandrel while it is supported, as by a crane, and replace the dull chipper head with another complete chipper head, a procedure requiring considerably less time than the replacement of each individual chipper knife on the chipper head while it remains on the arbor.

While other industrial machines, for example, milling machines for cutting surfaces on metal workpieces, have included a rotary cutting head which was connected to a drive unit by means of a self-releasing steeply tapered conical connection, such milling heads include a conical stub shaft which fits within a conical socket, rather than having a conical socket in a hub which fits over a conical arbor. The method of repairing such milling machine cutter heads is different, in any case, since individual knives are not reground, adjusted, and replaced. Instead, individual cutter bits of such a milling machine cutter head are simply thrown away and replaced with new cutter bits.

Machines such as metalworking lathes utilize a non-binding steeply tapered arbor to locate face plates or chucks on the drive shaft. Previously, however, there was no advantage seen in using this sort of a steeply tapered arbor for mounting a chipping head on a chipping machine.

A tapered arbor has, in fact, previously also been used in chipping machines, as illustrated in Hickman, U.S. Pat. No. 3,570,567, but no disclosure is made in this patent of a particularly steep taper of the arbor, nor any advantage to quick removal of the chipper head from the arbor.

The previously undiscovered advantage of such removability of a complete chipper head is that the chipper machine of the invention may thus be provided with a complete set of sharpened and aligned chipper knives in approximately five minutes of down time, as compared to the previously required 20 to 30 minutes of down time. Once a dulled chipper head has been removed from the chipper machine it may be removed to a shop where the individual chipper knives may be replaced with newly resharpened chipper knives which are first adjusted carefully, without the immediate pressure of time. The knives are finally dressed by a grinder to ensure that the plane-forming short leg portions of all of the knife edges rotate within a single plane, to provide a smooth planar surface on the workpiece. As a result of the final accurate grinder dressing of all of the chipper knives after installation in the chipper head, the chipper machine of the present invention is capable of providing a smoother plane surface on the work piece than is possible using the previously known method of individually replacing dulled chipper knives on a chipper head while it remains on the arbor of a chipper machine.

It is therefore a primary object of the present invention to provide a chipper machine in which dulled chipper knives may be replaced within a minimum of time during which use of the machine is prevented.

It is another important objective of the present invention to provide a chipper machine in which dulled chipper knives are replaced in precise alignment to provide a smooth plane surface on a work piece.

It is a further objective of the present invention to reduce the risk of damage to the edges of chipper knives during replacement of the chipper knives.

It is a principal feature of the present invention that the arbor and the mating socket in the hub of the chipper head of the chipper machine of the invention are provided with a taper which is sufficiently steep to permit quick release of the hub from the end of the mandrel.

It is another important feature of the present invention that it provides a movable anvil drop front to support a workpiece during operation of the chipper machine and still allow removal of the chipper head when the chipper knives have become dull.

It is a principal advantage of the present invention that it permits replacement of dulled chipper knives with a significantly shorter amount of time lost from chipper machine operation.

It is another important advantage of the present invention that it permits replacement of the individual chipper knives of a chipper head with greater precision than when the chipper head remains on the arbor of the chipper machine during installation of resharpened chipper knives.

It is yet further advantage of the present invention that it reduces the amount of material wasted during operation of the chipper machine, since it permits more precise adjustment of the position of the chipper head than was previously possible when chipper knives of the chipper head could not be so precisely located with respect to one another.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 4 is a simplified fragmentary side elevational view of the chipper machine of FIG. 1, taken along line 4—4 of FIG. 2.

FIG. 5 is a simplified fragmentary side elevational view of the chipper machine of FIG. 1, taken along line 4—4 of FIG. 2, showing the anvil drop front in a position permitting removal of the chipper head from the mandrel.

DETAILED DESCRIPTION OF THE INVENTION

Figure 1:
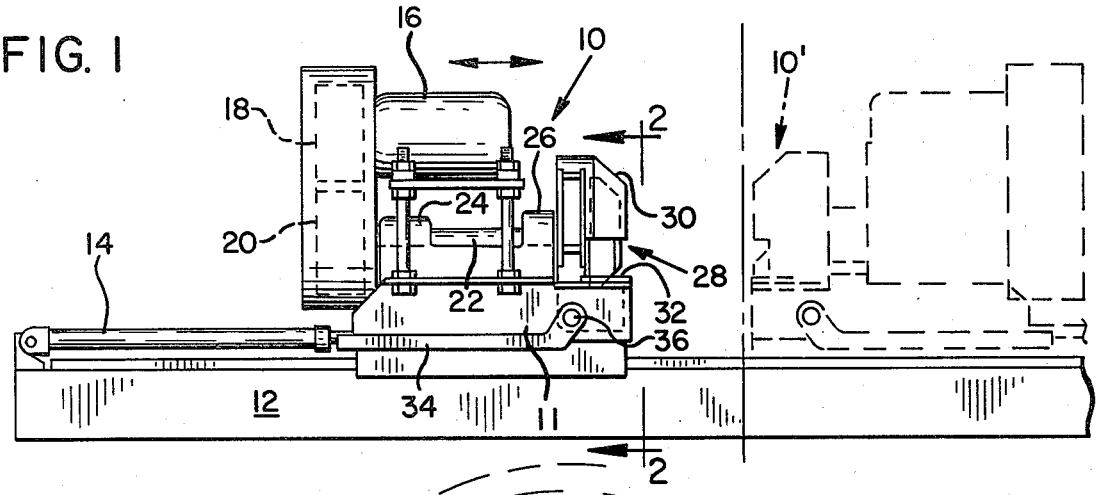
FIG. 1 is a side elevational view of a chipper machine embodying the present invention.

Referring now to FIG. 1 of the drawings, a chipper machine 10 is supported for movement along a pair of rails 12 by a hydraulic cylinder and piston assembly 14. Optionally, another chipper machine 10', shown in broken line, might be located in opposition to the chipper machine 10 to permit simultaneous removal of material from both of two opposing sides of a workpiece being moved between the two chipper machines.

The chipper machine 10 comprises, for example, two frame members 11, supporting a drive motor 16, drive pulleys 18 and 20, which may be operatively connected by belts, and a mandrel 22 to which the pulley 20 is fixedly attached. The mandrel 22 may be mounted for rotation in bearings 24 and 26, which provide radial and axial support for the mandrel 22. At the opposite end of the mandrel 22 from the pulley 20 is a chipper head 28 mounted on the mandrel 22 for rotation therewith. Protective shrouding 30 may be provided around a portion of the chipper head 28 to perform the dual function of protecting personnel from flying chips and deflecting the chips to a desired location for further handling. An anvil 32 is provided to support and position a workpiece as it is moved past the chipper head 28.

Figure 2:
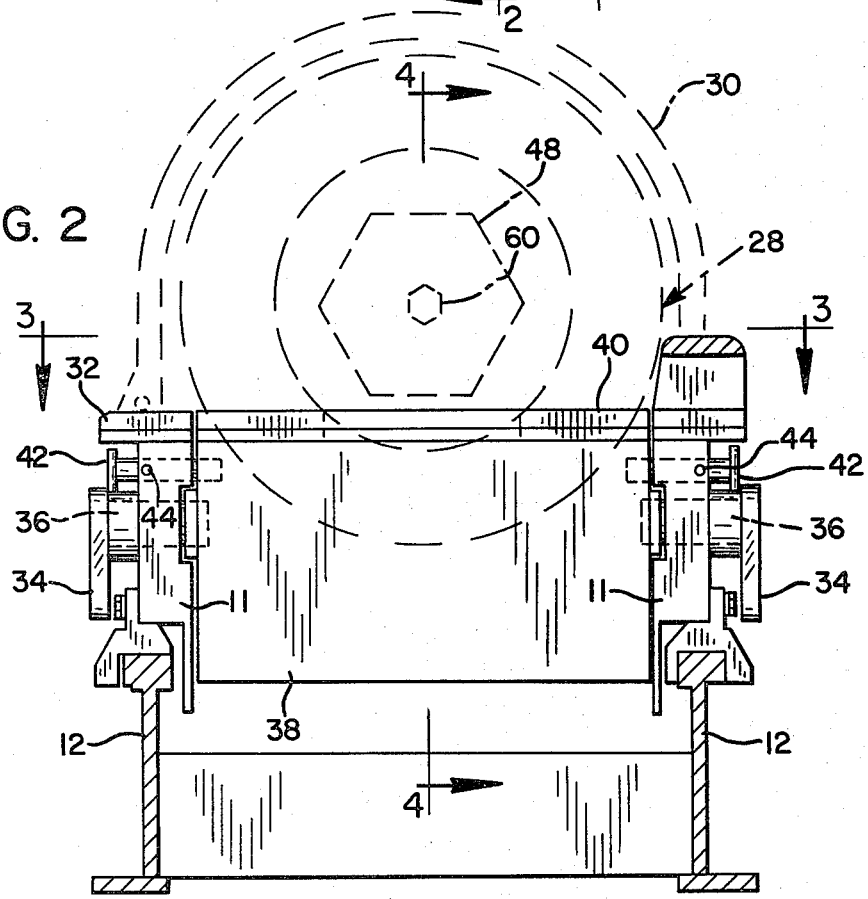
FIG. 2 is a front elevational view of the chipper machine of FIG. 1, taken along line 2—2.
Figure 3:
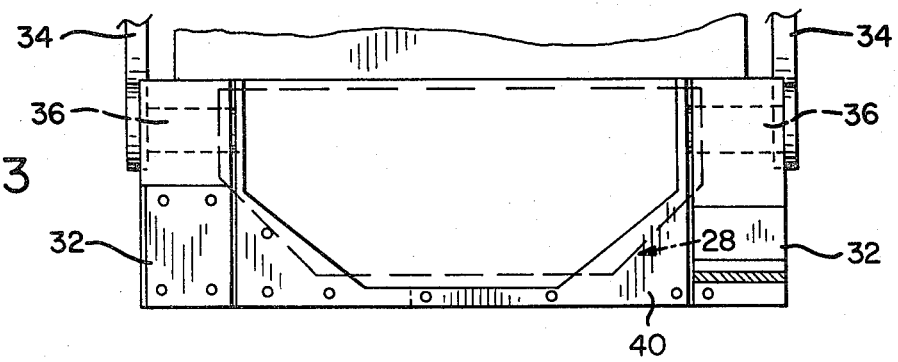
FIG. 3 is a fragmentary plan view of the chipper machine of FIG. 1, taken along line 3—3 of FIG. 2.

Referring now also to FIGS. 2 and 3, a lever arm 34 provided on each side of the chipper machine 10 is fixedly attached to a shaft 36, which in turn is fixedly interconnected with an anvil drop front 38 which includes a central portion 40 of the anvil 32. The central portion 40 of the anvil 32 is aligned with the remainder of the anvil 32 when the drop front portion 38 is in its normal position. The drop front 38 is held in its normal position by a pair of latch bars 42 which pass through apertures provided in frame members 11 into sockets defined in the drop front portion 38. Each latch bar 42 may be retained in its normal position engaging the drop front 38 by means such as a locking pin 44.

As may be seen in FIGS. 4 and 5, the drop front 38 may be lowered from its normal position shown in sectional side view in FIG. 4, in which the central portion 40 of the anvil 32 surrounds a portion of the chipper head 28. As may be seen in FIG. 5, the lever arm 34 may be raised, rotating the shafts 36 within apertures through the frame members 11. This thereby also rotates the central portion 40 of the anvil 32 in a downward and outward direction, away from the chipper head 28, to provide sufficient clearance for removal of the chipper head 28 from the mandrel 22.

Figure 6:
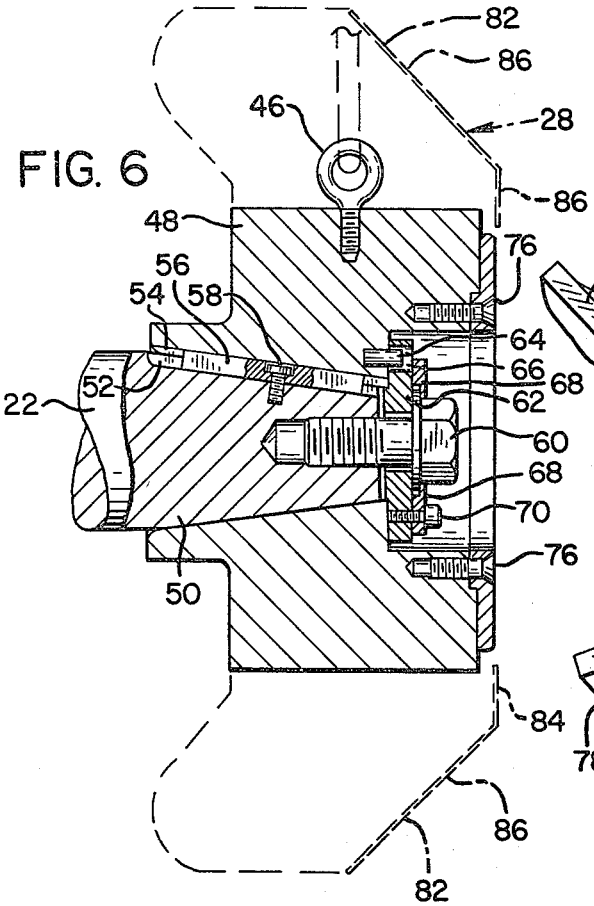
FIG. 6 is a simplified sectional side elevational view of the chipper head of the chipper machine of FIG. 1, taken along line 4—4 of FIG. 2.

The chipper head 28, shown in greater detail in FIG. 6, comprises a hub 48 which is preferably a regular polygon, the number of sides corresponding to the number of chipper knives of the chipper head. A frustoconical tapered arbor 50 fits matingly within a correspondingly tapered conical socket defined centrally within the hub 48 to locate the chipper head 28 on the mandrel 22. Keyways 52 and 54 extend axially along the arbor 50 and hub 48 to receive a key 56 which may be secured to the arbor 50 by means of a screw 58, to ensure rotation of the hub 48 with the arbor 50.

Figure 7:
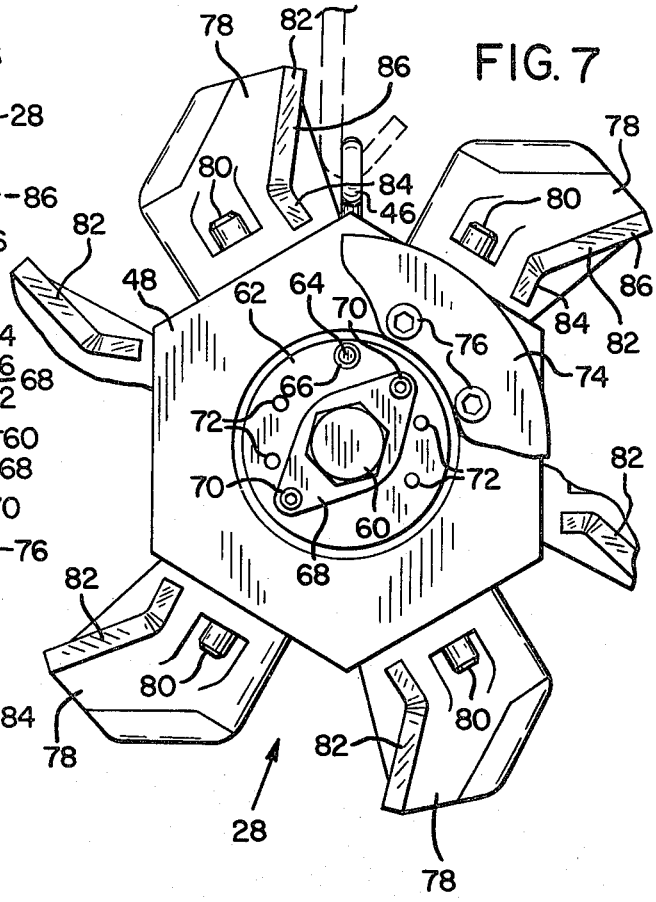
FIG. 7 is a partially cut away front view of the chipper head shown in FIG. 6.

An eyebolt 46, shown in FIGS. 5–7, permits the weight of the chipper head 28, which in many cases may be as much as 400 pounds or more, to be supported vertically by a crane at any time when the chipper head is not securely fastened to the mandrel 22. The eyebolt 46 is threaded and may additionally be welded into the hub 48, preferably at the same angular position as the key 54, to contribute to the static and dynamic balance of the chipper head, although counterweights (not shown) may additionally be used to dynamically balance the chipper head.

The taper of the arbor 50 and the socket of the hub 48 is sufficiently steep to prevent the socket from seizing upon the arbor 50. It has been found that a suitable taper for producing this effect is a reduction in diameter of 3.5 inches per foot of axial length of the arbor.

A retaining bolt 60 extends through a retaining plate 62 which in turn rests on a flat shoulder 63 defined within the hub 48. The retaining bolt 60 is threaded axially into the center of the end of the arbor 50 to retain the chipper head 28 securely on the arbor 50. The retaining plate 62 is prevented from rotating with respect to the hub 48 by a dowel 64 which extends from the hub 48 into an aperture 66 defined in the plate 62. A locking plate 68 may be secured by means of screws 70 extending into tapered holes 72 located at staggered intervals about the retainer plate 62, to retain the securing bolt 60 after it has been tightened into the threads in the end of the arbor 50.

A face plate 74 is secured by countersunk screws 76 which extend through the face plate 74 into the hub 48 to help guide a workpiece past the chipping head 28.

In FIG. 7, showing the chipper head with the face plate 74 partially cut away, a knife holder 78 is shown attached to the hub 48 by suitable fasteners including, for example, a bolt 80. Chipper knives 82 arranged about the hub 48, and carried by knife holders 78, each comprise a short leg edge 84 and a long leg edge 86. Each short leg edge 84 extends parallel to the face plate 74, located a slight distance, for example 0.015 inch, beyond the outer surface of the face plate 74. The long leg edges 86 extend further outwardly, and are directed back at an oblique angle toward the mandrel 22, so that when the chipper head 28 is rotated the long leg edges 86 describe a cone. Each of the chipper knives 82 is secured to the respective knife holder 78 in an adjustable fashion, the details of which are not important to the present invention. For example, one acceptable knife holder and chipper knife which could be used in the chipper machine of the invention is that disclosed in Miller U.S. Pat. No. 3,777,793, the disclosure of which has been incorporated herein by reference.

Figure 8:
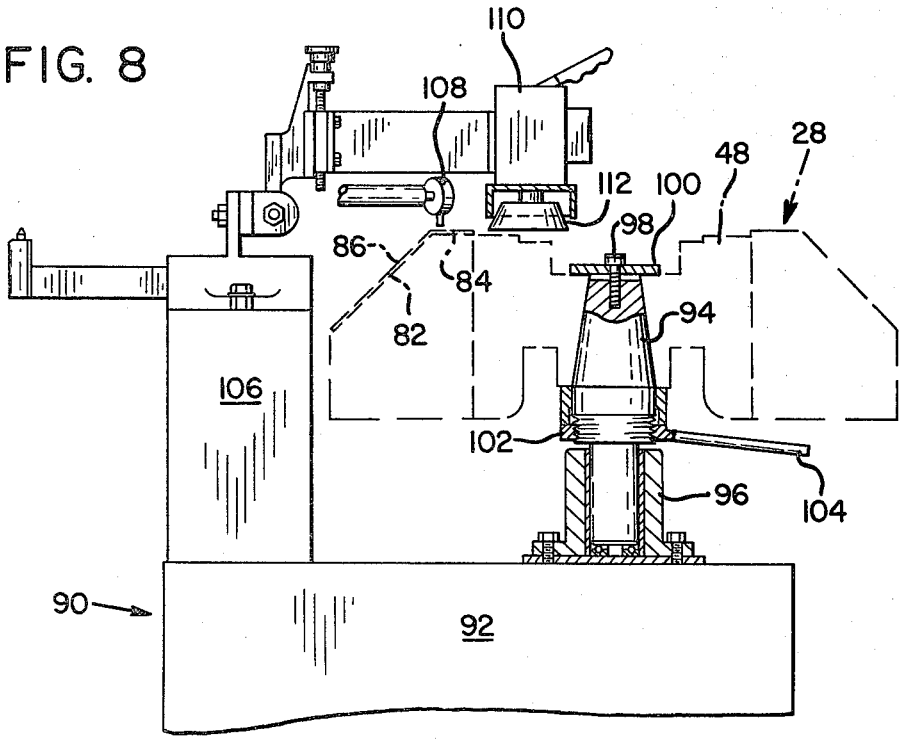
FIG. 8 is an elevational view of a jointer machine usable for aligning the chipper knives of the chipper head according to the invention, with a chipper head such as that of the chipper machine of FIG. 1 mounted thereon.

Referring to FIG. 8, the chipper head 28 may be seen in place on a jointer 90 comprising a base portion 92 upon which is mounted a dummy arbor 94, supported for rotation in suitable bearings 96. A retaining bolt 98 and retaining plate 100 hold the chipper head securely to the dummy arbor 94, while a jacking collar 102, rotatable by means of a handle 104, is threaded about the dummy arbor 94 below the chipper head 28. A grinder support stand 106 supports a movably mounted dial indicator 108 and a surface grinder 110 equipped, for example, with a rotary grindstone 112.

In practicing the method of the invention for setting up a chipper head 28 the chipper knives 82 are not individually removed from each respective knife holder 78 while the chipper head is installed on the chipper machine 10, as has been done in the past. Instead, the entire chipper head 28 is removed from the arbor 50 and replaced by a chipper head 28 which has been provided with resharpened and precisely aligned chipper knives 82, whose short leg edges 84 have all been precisely ground to rotate within a single cutting plane.

In particular, when it has been determined that the chipper knives 82 of a chipper head 28 have become dulled beyond acceptable limits, the chipper machine 10 is stopped and the chipper head 28 is rotated to bring the lifting eyebolt 46 to a position vertically above the center of the arbor 52. The latch bars 42 are moved outward from their positions locking the drop front 38 in its normal raised position. Thereafter, the levers 34 are raised to rotate the shaft 36, thereby lowering the drop front section 38 and removing the central portion 40 of the anvil 32 from its normal position surrounding a portion of the chipper head 28. Lowering the drop front section 38 provides clearance for removal of the chipper head 28 axially from the arbor 50.

This is accomplished by connecting a crane to the lifting eyebolt 46 by means of a hook or strap and applying sufficient lifting force to support the weight of the chipper head 28. Next the screws 78 and locking plate 68 are removed, permitting loosening of the retaining bolt 60 from the threaded end of the arbor 50.

Because of the self-releasing steep taper of the arbor 50 and corresponding socket within the hub 48, all that is required is a slight tapping of the hub 48 to free the hub from the arbor 50, after which the hub 48 will freely slides from the arbor 50. The retaining bolt 60 and retaining plate 62 may then be removed from the arbor and with the weight of the chipper head 28 supported by the crane, the chipper head 28 is withdrawn from the arbor 50. Thereafter, a replacement chipper head 28 whose chipper knives 82 have been resharpened, precisely repositioned, clamped, and then ground to ensure a planar cut, may be placed on the arbor 50 and secured by the reverse of the above-described process of removal.

The entire removal and replacement process takes only a very short amount of time as compared with individually replacing each of the chipper knives 82 in its respective knife holder 78 and thereafter adjusting the chipper knives on a particular chipper head 28 while it remains mounted on an arbor 50.

The chipper head 28 having dulled chipper knives 82 is removed for sharpening and setting up preferably in a clean location away from the chipper machines, permitting removal, sharpening, and accurate replacement of the individual chipper knives 82 in their respective knife holders 78. In particular, the chipper head 28 may be placed on the dummy arbor 94 of the jointer 90, where it is secured in position by the securing bolt 98 and securing plate 100. After removal of the chipper knives 82 and grinding of the short leg and long leg edges 84 and 86 of each chipper knife 82, the chipper knives 82 are replaced in their respective knife holders 78 and carefully adjusted to the desired position. As the chipper head 28 and dummy arbor 94 are rotated in the bearings 96 to bring each chipper knife 82 sequentially into position for measurement, the dial indicator 108 is used to position each chipper knife 82. Once all of the chipper knives 82 have been carefully adjusted and securely fastened in position, all of the short leg edges 84 are very lightly dressed using the grinding stone 112 of the surface grinder 110, to bring all of the short leg edges 84 into a single cutting plane slightly exposed beyond the eventual location of the outer surface of the face plate 74. Although the individual chipper knives 82 may be initially located within a very few thousandths of an inch of the same plane of rotation by use of the dial indicator 108, this dressing of the short leg edges 84 by the surface grinder 110 assures that each of the short leg edges 84 is subjected to essentially the same amount of wearing cutting load, and provides a more accurately and smoothly cut surface on a workpiece.

After the short leg edges 84 have been dressed, the dial indicator 108 and the surface grinder 110 are swung clear, the retaining bolt 98 and the retaining plate 100 are removed, and the contact between the dummy arbor 98 and socket in the hub 48 of the chipper head 28 is broken by rotating the handle 104 of the jacking collar 102 with respect to the dummy arbor 94 to raise the chipper head 28 slightly. Thereafter, the chipper head 28 may be lifted free by the use of a crane or other appropriate equipment, and the chipper head 28 may be replaced on the arbor 50 of a chipper machine.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A chipper machine for simultaneously forming a flat surface on a workpiece and comminuting material removed from the workpiece, comprising:

(a) a rotatable mandrel having a tapered arbor;

(b) a rotary chipper head mounted on said tapered arbor, said chipper head having a plurality of individually removable chipper knives mounted thereon, and said chipper head also having a hub including a tapered socket for matingly fitting on said tapered arbor;

(c) anvil means for supporting a workpiece in position for being engaged by said chipper head, a drop front portion of said anvil means being movable between a first position, in which said drop front portion partially surrounds said chipper head preventing its removal from said arbor, and a second position providing sufficient clearance for removal of said chipper head from said arbor.

2. The chipper machine of claim 1, wherein said drop front portion is pivotably mounted, including a shaft connected to said drop front portion, and a lever connected to said shaft, said lever and shaft being rotatable to pivot said drop front portion to said second position.

3. The chipper machine of claim 2, including a latch bar for retaining said drop front portion of said anvil in said first position.

4. The chipper machine of claim 1, comprising a single centrally located retaining bolt for holding said hub onto said arbor, and locking means for securing said retaining bolt in a tightened position.

5. A chipper machine for simultaneously forming a flat surface on a workpiece and comminuting material removed from the workpiece, comprising:

(a) a rotatable mandrel having a tapered arbor;

(b) a rotary chipper head mounted on said tapered arbor, said chipper head having a plurality of individually removable chipper knives mounted thereon, and said chipper head also having a hub including a tapered socket for matingly fitting on said tapered arbor, the diameter of the mating portions of said tapered arbor and of said tapered socket decreasing at least about 3.5 inches per foot of axial length of said mating portions; and (c) anvil means for supporting a workpiece in position for being engaged by said chipper head, a drop front portion of said anvil means being movable between a first position, in which said drop front portion partially surrounds said chipper head preventing its removal from said arbor, and a second position providing sufficient clearance for removal of said chipper head from said arbor.

* * * * *